US010081196B2

(12) United States Patent
Yoshida et al.

(10) Patent No.: US 10,081,196 B2
(45) **Date of Patent: *Sep. 25, 2018**

(54) CARTRIDGE-TYPE INKJET RECORDING DEVICE

(71) Applicant: Hitachi Industrial Equipment Systems Co., Ltd., Chiyoda-ku, Tokyo (JP)

(72) Inventors: Naomichi Yoshida, Tokyo (JP); Akira Miyao, Tokyo (JP); Takehiko Matsushita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/655,407

(22) Filed: Jul. 20, 2017

(65) Prior Publication Data

US 2017/0313094 A1 Nov. 2, 2017

Related U.S. Application Data

(63) Continuation of application No. 15/111,619, filed as application No. PCT/JP2014/069638 on Jul. 25, 2014, now Pat. No. 9,738,086.

(30) Foreign Application Priority Data

Jan. 27, 2014 (JP) ..... 2014-011960

(51) Int. Cl.
*B41J 2/175* (2006.01)
*B41J 2/08* (2006.01)
*B41J 2/17* (2006.01)

(52) U.S. Cl.
CPC ..... *B41J 2/17566* (2013.01); *B41J 2/08* (2013.01); *B41J 2/175* (2013.01); *B41J 2/1721* (2013.01);

(Continued)

(58) Field of Classification Search
CPC .... B41J 2/175; B41J 2/17506; B41J 2/17509; B41J 2/1752; B41J 2/17523
See application file for complete search history.

(56) References Cited

U.S. PATENT DOCUMENTS 6,158,854 A 12/2000 Watts et al.
2004/0001126 A1 1/2004 Oda et al.
(Continued)

FOREIGN PATENT DOCUMENTS

CN 101027187 A 8/2007
EP 0 928 693 A1 7/1999
(Continued)

OTHER PUBLICATIONS

International Search Report (PCT/ISA/210) issued in PCT Application No. PCT/JP2014/069638 dated Nov. 11, 2014 with English-language translation (three (3) pages).
(Continued)

*Primary Examiner* — Julian Huffman
(74) *Attorney, Agent, or Firm* — Crowell & Moring LLP

(57) ABSTRACT

A cartridge-type inkjet recording device that can accurately and easily connect a cartridge-type replenishing liquid bottle to an inkjet recording device is presented herein. This cartridge-type inkjet recording device includes a liquid reservoir to which a replenishing liquid bottle can be attached or removed. The liquid reservoir has a liquid replenishment opening for replenishing liquid from the cartridge-type replenishing liquid bottle. The liquid reservoir also has a cam that is provided to the periphery of the liquid replenishment opening, engages a portion of the cartridge-type replenishing liquid bottle, and moves the cartridge-type replenishing liquid bottle in the vertical direction, and a cam operation section that operates the cam.

11 Claims, 11 Drawing Sheets

(52) U.S. Cl.
CPC ..... *B41J 2/1752* (2013.01); *B41J 2/17506* (2013.01); *B41J 2/17509* (2013.01); *B41J 2/17513* (2013.01); *B41J 2/17523* (2013.01); *B41J 2/17553* (2013.01)

(56) References Cited

U.S. PATENT DOCUMENTS

| | | | |
|---|---|---|---|
| 2004/0060915 | A1 | 4/2004 | Maeda |
| 2004/0119799 | A1 | 6/2004 | Kulpa et al. |
| 2005/0151803 | A1 | 7/2005 | Wilson, II et al. |
| 2005/0231568 | A1 | 10/2005 | Wilson, II et al. |
| 2007/0132819 | A1 | 6/2007 | Umeda et al. |
| 2008/0158284 | A1 | 7/2008 | Nakamura et al. |

FOREIGN PATENT DOCUMENTS

| | | | |
|---|---|---|---|
| JP | 11-245431 | A | 9/1999 |
| JP | 2002-245670 | A | 9/2002 |
| JP | 2002-254670 | A | 9/2002 |
| JP | 2003-251110 | A | 9/2003 |
| JP | 2004-119799 | A | 4/2004 |
| JP | 2007-152559 | A | 6/2007 |
| JP | 2007-517689 | A | 7/2007 |
| JP | 2010-173101 | A | 8/2010 |
| JP | 2015-112843 | A | 6/2015 |

OTHER PUBLICATIONS

Japanese-language Written Opinion (PCT/ISA/237) issued in PCT Application No. PCT/JP2014/069638 dated Nov. 11, 2014 (four (4) pages).

Chinese-language Office Action issued in counterpart Chinese Application No. 201480074225.X dated Jan. 3, 2017 (Seven (7) pages).

Extended European Search Report issued in counterpart European Application No. 14880102.0 dated Aug. 24, 2017 (nine (9) pages).

Japanese-language Office Action issued in counterpart Japanese Application No. 2017-149619 dated May 15, 2018 (three (3) pages).

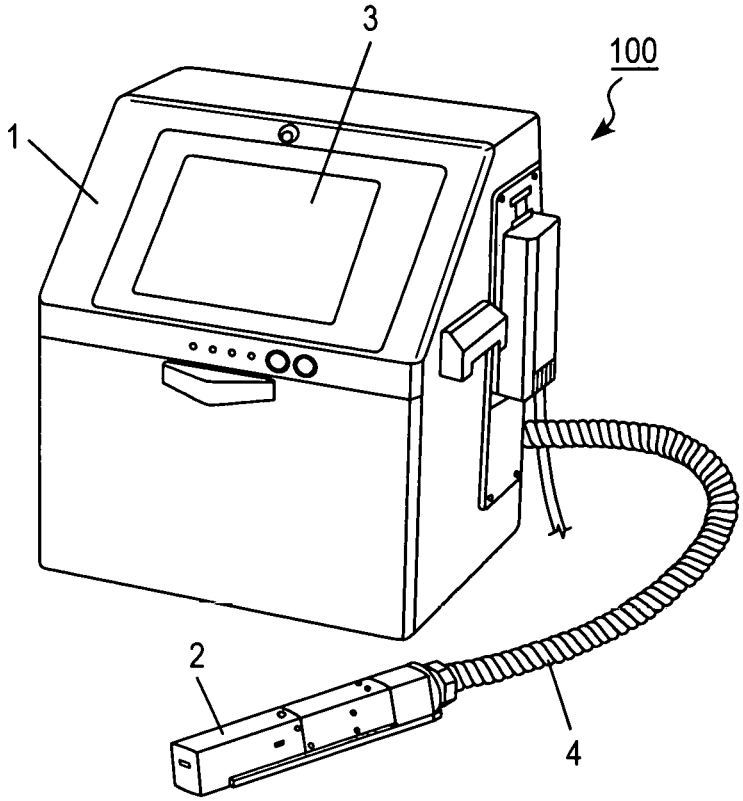
FIG. 1
FIG. 2
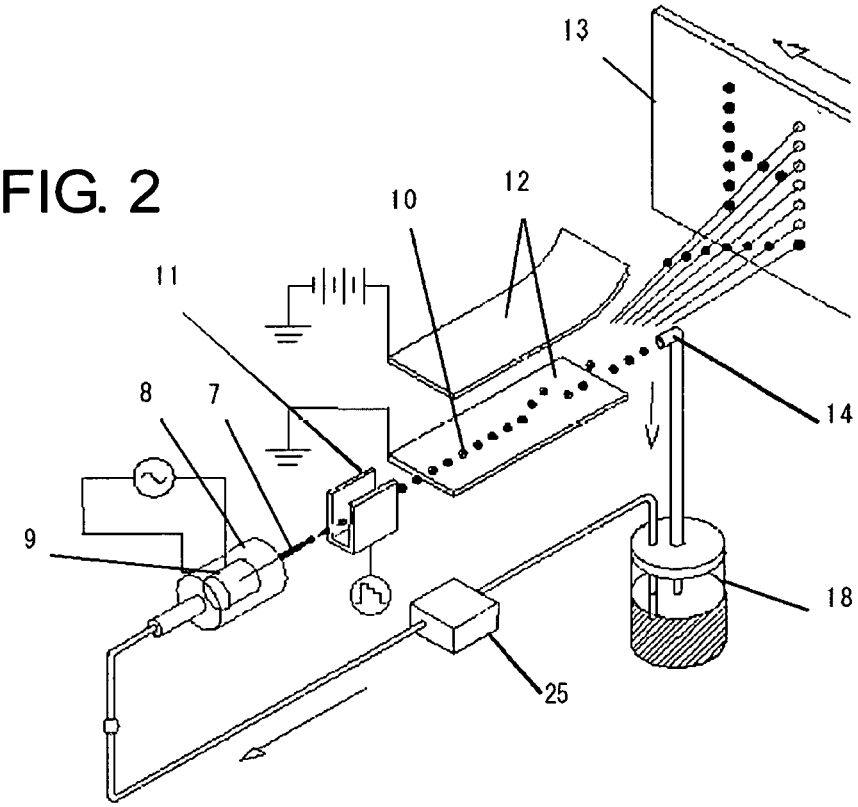

CARTRIDGE-TYPE INKJET RECORDING DEVICE

CROSS REFERENCE TO RELATED APPLICATIONS

This application is a continuation of U.S. application Ser. No. 15/111,619, filed Jul. 14, 2016, which is a 371 of International Application No. PCT/2014/069638, filed Jul. 25, 2017, which claims priority from Japanese Patent Application No. 2014-011960, filed Jan. 27, 2014, the disclosures of which are expressly incorporated by reference herein.

TECHNICAL FIELD

The present invention relates to a cartridge-type inkjet recording device.

BACKGROUND ART

As a background art of this technical field, there is JP-A-11-245431 (Patent Literature 1). Patent Literature 1 mentions that "a vessel 1 is liquid-tightly connected to an ink system by pressing a connector 7 against an adapter 3 in an axial direction. Then, ink or a solvent in the vessel 1 flows into the ink system through a connecting section and supply of desired liquid is performed."

Further, there is JP-A-2003-251110 (Patent Literature 2). Patent Literature 2 describes "a connector device including a fixing section including, on a lower surface side, a plurality of connecting pipes that can be hermetically attached to and removed from a fluid outlet/inlet pipe during mounting and demounting of a cartridge, a movable table including a flange holding section that holds a horizontal flange such that the fluid outlet/inlet pipe is aligned with the connecting pipes, a guiding mechanism including two elongated members crossing in an X shape and pivotally attached to each other in a crossing point in the center to restrain the movable table to be movable in the vertical direction, pins attached to end portions of the elongated members, and horizontal slots respectively provided on side surfaces of the fixing section and the movable table to horizontally guide the pins, and a cam slot for moving a cam pin fixed to the movable table up and down, the cam slot being an operation lever pivotally attached to the fixing section at one end portion and including a handle at the other end portion, the connector device including the operation lever" (see the abstract).

CITATION LIST

Patent Literature

Patent Literature 1: JP-A-11-245431
Patent Literature 2: JP-A-2003-251110

SUMMARY OF INVENTION

Technical Problem

The replacement-type liquid vessel described in Patent Literature 1 needs to be pressed in the axial direction in order to connect the replacement-type liquid vessel to the adapter on the main body side. A large pressing force is necessary depending on assembly accuracy of the replacement-type liquid vessel and the adapter. The connection is likely to be difficult by manual work. When a replacement-type vessel is replaced in a housing of an inkjet recording device and when replacement work needs to be performed in a narrow place, in the connection in the axial direction, it is also likely that a sufficient pressing force cannot be applied by manual work.

Patent Literature 2 describes the connector device for connecting a cartridge of a filter. Patent Literature 2 mentions that it is possible to move the filter in the vertical direction and connect the filter to a connector by setting the filter and pushing down the operation lever. However, concerning alignment in the connection of the filter and the connector, it is necessary to push in the filter along a guiderail of the connector device and accurately move the filter to a predetermined position. When the filter is not pushed in to the predetermined position, it is likely that the filter is not properly connected.

Therefore, an object of the present invention is to provide a cartridge-type inkjet recording device capable of accurately and easily connecting a cartridge-type replenishing liquid bottle and an inkjet recording device.

Solution to Problem

This application includes a plurality of means for solving the problems. An example of the means is a cartridge-type inkjet recording device including a liquid reservoir to which a replenishing liquid bottle is removably attachable. The liquid reservoir includes a liquid replenishment opening for replenishing liquid from the cartridge-type replenishing liquid bottle, a cam that is provided on the periphery of the liquid replenishment opening, engages with a portion of the cartridge-type replenishing liquid bottle, and moves the cartridge-type replenishing liquid bottle in the vertical direction, and a cam operation section that operates the cam.

Advantageous Effects of Invention

According to the present invention, it is possible to provide a cartridge-type inkjet recording device capable of accurately and easily connecting a cartridge-type replenishing liquid bottle and an inkjet recording device.

BRIEF DESCRIPTION OF DRAWINGS

FIG. 1 is a perspective view showing an inkjet recording device and a printing head exterior.

FIG. 2 is a perspective view showing a principle of an inkjet recording device.

DESCRIPTION OF EMBODIMENTS

Figure 3:
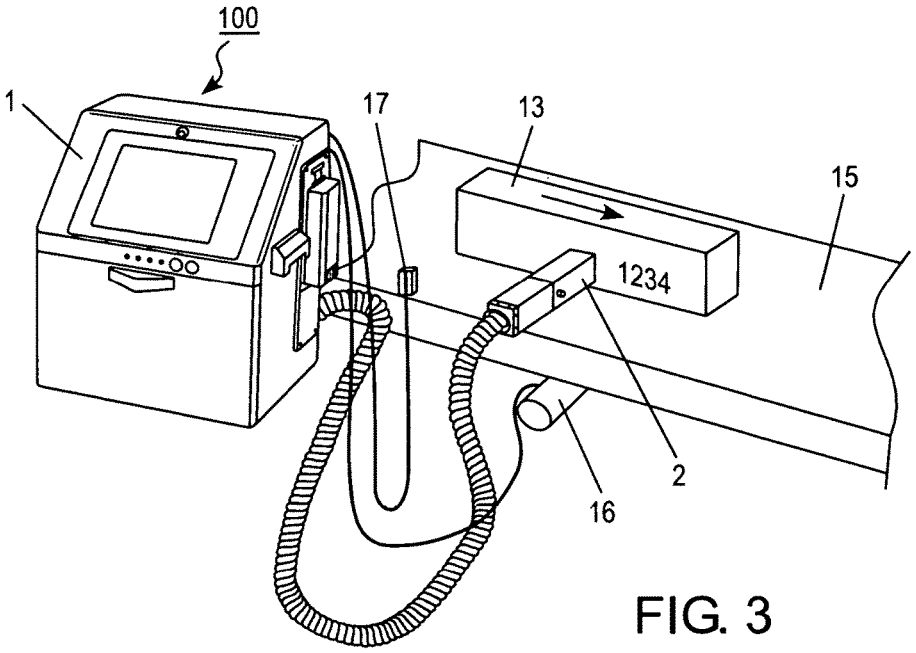
FIG. 3 is a perspective view showing a state of use of the inkjet recording device.

Embodiments are explained in detail below with reference to illustrated examples. Note that the present invention is not limited to the illustrated examples.

First Embodiment

FIG. 1 is a perspective view showing an inkjet recording device 100. The inkjet recording device 100 includes a main body 1, on the outside of which an operation display section 3 is provided, and a printing head 2. The main body 1 and the printing head 2 are connected by a conduit 4.

An operation principle of the inkjet recording device 100 is explained. As shown in FIG. 2, ink in an ink tank 18 is sucked and pressurized by a pump 25 and discharged from a nozzle 8 as an ink column 7. The nozzle 8 includes an electrostrictive element 9. Vibration is applied to the ink at a predetermined frequency to convert the ink column 7 discharged from the nozzle 8 into particles. Consequently, the number of ink particles 10 to be generated is determined by a frequency of an excitation voltage applied to the electrostrictive element 9 and is the same number as the frequency.

A voltage having magnitude corresponding to printing information is applied to the ink particles 10 by a charging electrode 11, whereby electric charges are given to the ink particles 10. While flying in an electric field generated between deflection electrodes 12, the ink particles 10 charged by the charging electrode 11 receive force proportional to a charging amount and deflect, fly toward a printing target object 13, and impact on the printing target object 13. In that case, an impact position in a deflecting direction of the ink particles 10 changes according to the charging amount. A production line moves the printing target object 13 in a direction orthogonal to the deflecting direction. Consequently, it is possible to impact the particles in the direction orthogonal to the deflecting direction as well. A character is formed by a plurality of impacted particles to perform printing. The ink particles 10 not used for the printing linearly fly between the deflection electrodes 12. After being captured by a gutter 14, the ink particles 10 are collected in the main ink tank 18 through a route.

An example of an actual state of use of the inkjet recording device 100 is shown in FIG. 3. The inkjet recording device 100 is installed in, for example, a production line in a factory where foods, drinks, and the like are produced. The main body 1 is set in a position where a user can operate the main body 1. The printing head 2 is set in a position where the printing head 2 can approach the printing target object 13 fed on the production line such as a belt conveyor 15.

On the production line such as the belt conveyor 15, in order to perform printing at the same width irrespective of feeding speed, an encoder 16 that outputs a signal corresponding to the feeding speed to the inkjet recording device 100 and a printing sensor 17 that detects the printing target object 13 and outputs a signal for instructing the inkjet recording device 100 to perform printing are set. The encoder 16 and the printing sensor 17 are connected to a not-shown control section in the main body 1.

The control section controls, according to the signals from the encoder 16 and the printing sensor 17, a charging amount and charging timing for the ink particles 10 discharged from the nozzle 8, causes the ink particles 10, which are charged and deflected while the printing target object 13 passes the vicinity of the printing head 2, to adhere to the printing target object 13, and performs printing.

Figure 4:
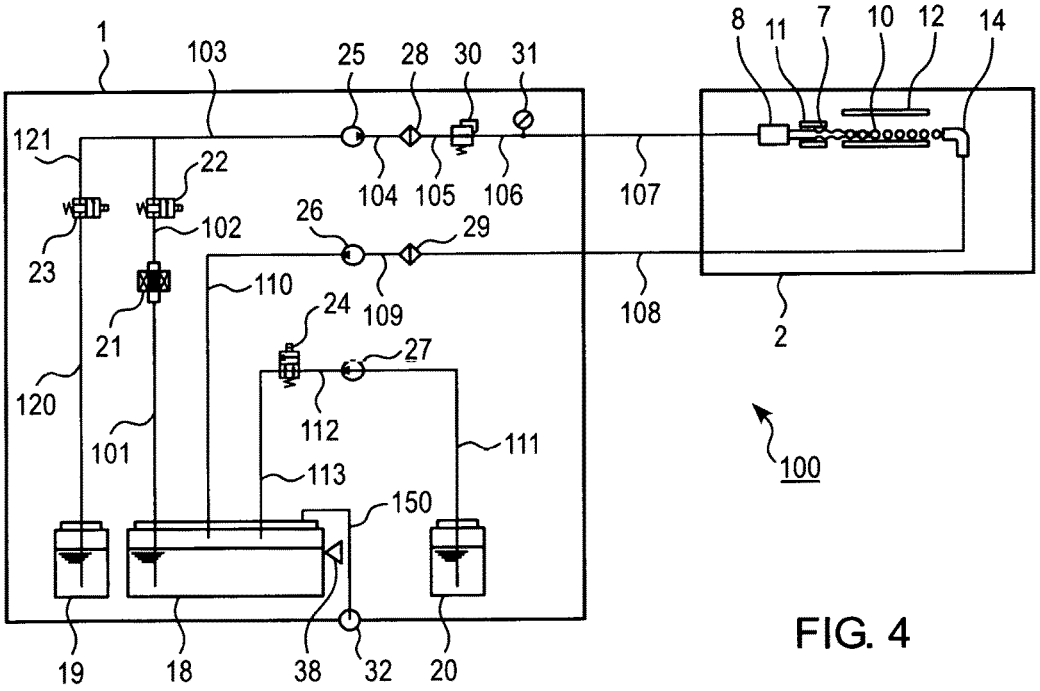
FIG. 4 is a diagram showing a circulation system route configuration of the inkjet recording device.

FIG. 4 is an explanatory diagram showing an overall route configuration of the inkjet recording device 100. The main body 1 includes the main ink tank 18 that stores ink to be circulated. The main ink tank 18 includes a liquid level sensor 38 that detects whether the liquid in the main ink tank 18 has reached a reference liquid level, which is an amount appropriate for the liquid in the main ink tank 18 to be stored on the inside of the main ink tank 18. The main ink tank 18 is connected to a viscometer 21, which is a drop-type viscometer for measuring the viscosity of ink, via a route 101 for circulating the ink.

The viscometer 21 is connected to, via a route 102, an electromagnetic valve 22 that performs opening and closing of a route. The electromagnetic valve 22 is connected to, via a route 103, the pump 25 served for suction and pumping of ink and a solvent. The pump 25 is connected to, via a route 104, a filter 28 for removing foreign matters mixed in the ink.

The filter 28 is connected to, via a route 105, a pressure reducing valve 30 that adjusts the ink pumped from the pump 25 to pressure appropriate for performing printing. The pressure reducing valve 30 is connected to, via the route 106, a pressure sensor 31 for detecting the pressure of the ink.

The pressure sensor 31 is connected to, via a route 107 passing through the conduit 4, the nozzle 8 provided in the printing head 2 and including a discharge opening for discharging the ink.

In an ink discharge direction of the nozzle 8, the charging electrode 11 is disposed that charges the ink particles 10 with a charging amount corresponding to character information to be printed with the ink particles 10 discharged from the nozzle 8. In a flying direction of the ink particles 10 charged by the charging electrode 11, the deflection electrodes 12 are disposed that generate an electric field for deflecting the charged ink particles 10.

On the ink flying direction side of the deflection electrodes 12, the gutter 14 is disposed that captures the ink particles 10 linearly flying without being charged and deflected because not used for printing.

The gutter 14 is connected to, via a route 108 passing through the conduit 4, a filter 29 for removing foreign matters mixed in the ink disposed in the main body 1. The filter 29 is connected to, via a route 109, a collection pump 26 that sucks the ink particles 10 captured by the gutter 14. The collection pump 26 collects, via a route 110, the sucked ink particles 10 in the main ink tank 18.

In the main body 1, an exhaust opening 32 is provided. The exhaust opening 32 is connected to the main ink tank 18 via a route 150. A volatilized solvent component in the ink is exhausted to the outside of the main body 1 via the route 150.

The main body 1 includes a solvent reservoir 20 that stores a solvent for eliminating contamination by the ink, which occurs in the nozzle 8, and adjusting the concentration of the ink. The solvent reservoir 20 is connected to, via the route 111, a pump 27 that performs suction and pumping of the solvent. The pump 27 is connected to, via a route 112, an electromagnetic valve 24 that performs opening and closing of a route. The electromagnetic valve 24 is connected to the main ink tank 18 via a route 113.

Further, the main body 1 includes an auxiliary ink reservoir 19 that stores ink to be replenished. The auxiliary ink reservoir 19 is connected to, via a route 120, an electromagnetic valve 23 that performs opening and closing of a route. The electromagnetic valve 23 is connected to the route 103 via a route 121.

A cartridge-type replenishing liquid bottle 600 is removably attachable to the auxiliary ink reservoir 19 and the solvent reservoir 20. An attaching and removing configuration of the replenishing liquid bottle 600 is explained below.

Subsequently, a connecting mechanism for the liquid reservoir and the replenishing liquid bottle on the main body side, a connecting method to the ink or solvent reservoir, and a liquid reservoir exterior in this embodiment are explained with reference to FIG. 5 to FIG. 9.

Figure 5:
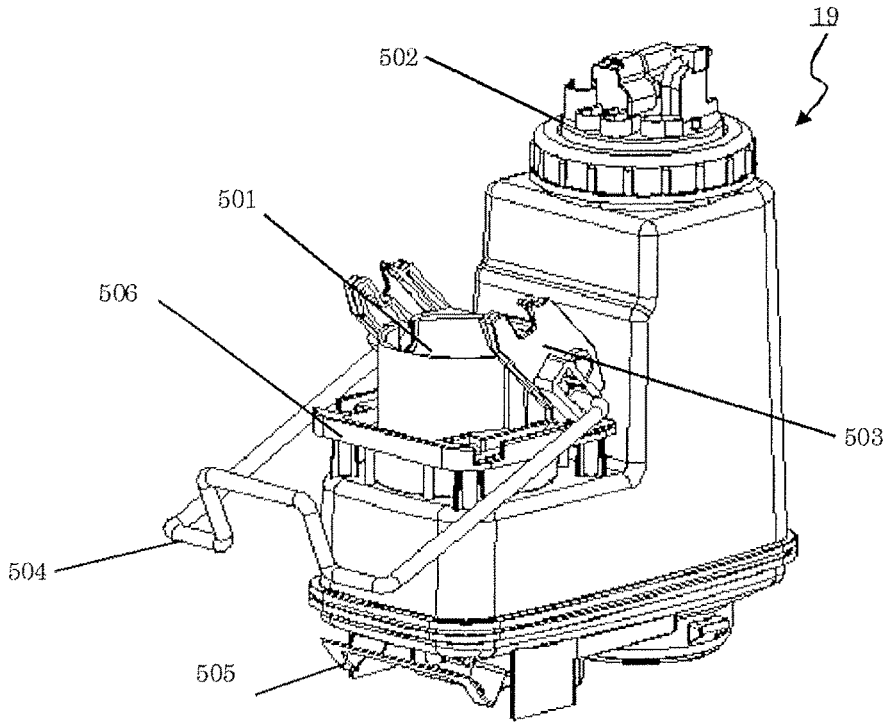
FIG. 5 is a diagram for explaining a bottle drawing-in mechanism to the inkjet recording device in a first embodiment.

FIG. 5 is an example of a structural drawing for connecting the replenishing liquid bottle 600 to the auxiliary ink reservoir 19 or the auxiliary makeup reservoir 20 on the main body 1 side. The auxiliary ink reservoir 19 or the makeup reservoir 20 is set in the main body 1. A replenishing operation is performed in the inkjet recording device 100. Note that the auxiliary ink reservoir 19 and the makeup reservoir 20 have the same bottle drawing-in configuration. Only the auxiliary ink reservoir 19 is explained here.

In FIG. 5, first, the structure of the auxiliary ink reservoir 19 is explained. The auxiliary ink reservoir 19 includes a liquid replenishment opening 501 and an atmospheric air opening 502. The liquid replenishment opening 501 is a connection opening to the replenishing liquid bottle 600. A sensor for detecting a liquid level in the auxiliary ink reservoir is attached to the atmospheric air opening 502.

An adapter 506 connected to the replenishing liquid bottle 600 is provided on the periphery of the liquid replenishment opening 501. Not-shown bosses are provided at left and right both ends of the adapter 506. Lever cams 503 are provided in the bosses. Further, an operation lever 504 is attached to the lever cams 503 as an operation section that operates the lever cams 503. The lever cams 503 are operated by the operation lever 504 to connect the replenishing liquid bottle 600 to the auxiliary ink reservoir 19.

A lever positioning plate 505 is provided at the lower end of the auxiliary ink reservoir 19. The replenishing liquid bottle 600 is fixed and positioned by the operation lever 504 and the lever positioning plate 505 not to topple when the replenishing liquid bottle 600 is connected to the auxiliary ink reservoir 19. A connection method for the auxiliary ink reservoir 19 and the replenishing liquid bottle 600 is explained below.

Note that, in this embodiment, an operation section that operates the lever cams 503 is the operation lever 504. However, a cam operation section is not limited to this mechanism. For example, the cam operation section may be a mechanism that applies, when the replenishing liquid bottle 600 is connected, stress to the replenishing liquid bottle 600 from above the replenishing liquid bottle 600 to operate the cam. Further, the cam operation section may be operated as a configuration in which the control section can automatically control the operation of the cam itself.

Figure 6A:
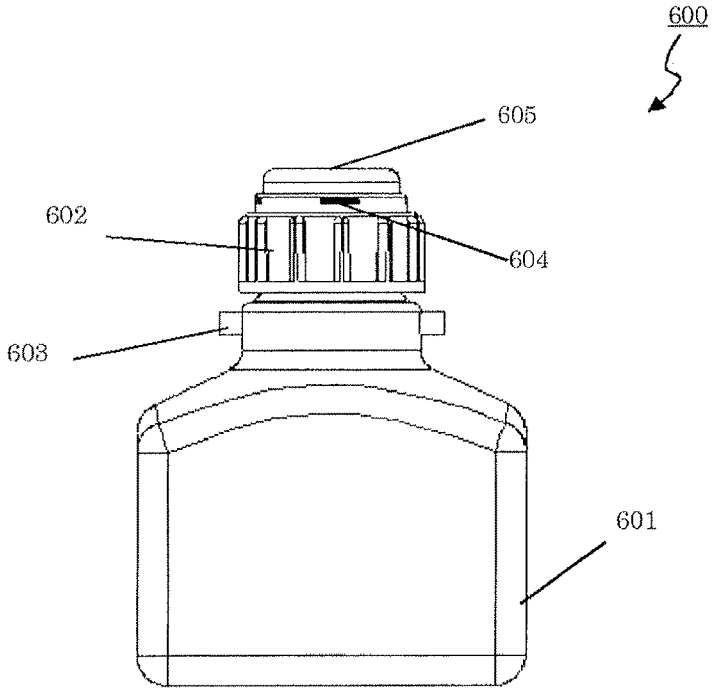
FIG. 6A is an overall view of a replenishing liquid reservoir in the first embodiment.
Figure 6B:
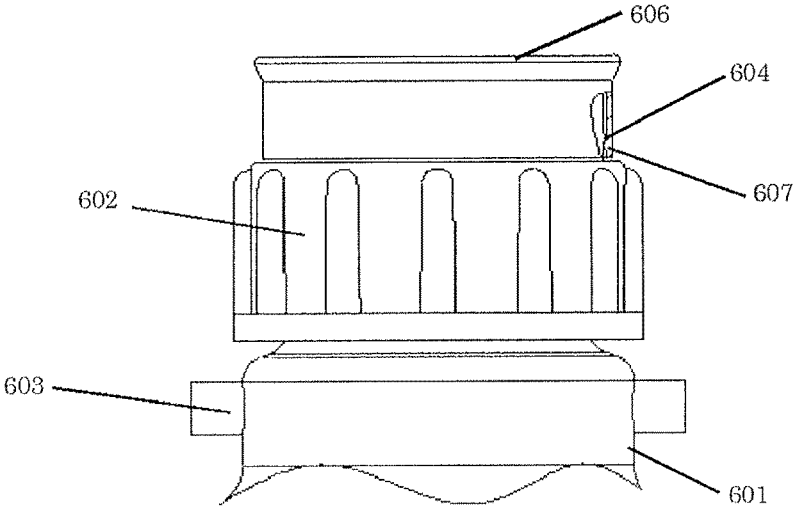
FIG. 6B is an enlarged view of a connecting section to a supplementary ink reservoir in the replenishing liquid bottle in the first embodiment.

The configuration of the replenishing liquid bottle 600 connected to the auxiliary ink reservoir 19 is explained with reference to FIGS. 6A and 6B. FIG. 6A is an overall view of the replenishing liquid bottle 600. FIG. 6B is an enlarged view of a connecting section of the replenishing liquid bottle 600 and the auxiliary ink reservoir 19.

Ink or a solvent is stored in a liquid storing section 601 of the replenishing liquid bottle 600. A bottle cap 602 is attached to a bottle opening of the liquid storing section 601. Bosses 603 are provided in a part of the liquid storing section 601 and integrated with the liquid storing section 601. The bosses 603 are used when the liquid storing section 601 is connected to the auxiliary ink reservoir 19. Therefore, resin is filled in the insides of the bosses 603 to secure strength of the bosses 603.

The bottle cap 602 attached to the replenishing liquid bottle 600 forms an opening section in a cap top surface 605. Therefore, when the replenishing liquid bottle 600 is not used, as shown in FIG. 6B, intrusion of dust into the inside of the replenishing liquid bottle 600 can be prevented by attaching an over-cap 606.

As a holding method for the over-cap 606, a protrusion 607 on the inside of the over-cap 606 is pushed in and fit with a protrusion 604 on the outer side of the bottle cap 602. It is possible to prevent a leak and smell of the remaining ink by attaching the over-cap 606 to the replenishing liquid bottle 600 after use.

Connection of a liquid storage reservoir 500 and the replenishing liquid bottle 600 is explained with reference to FIG. 7.

Figure 7A:
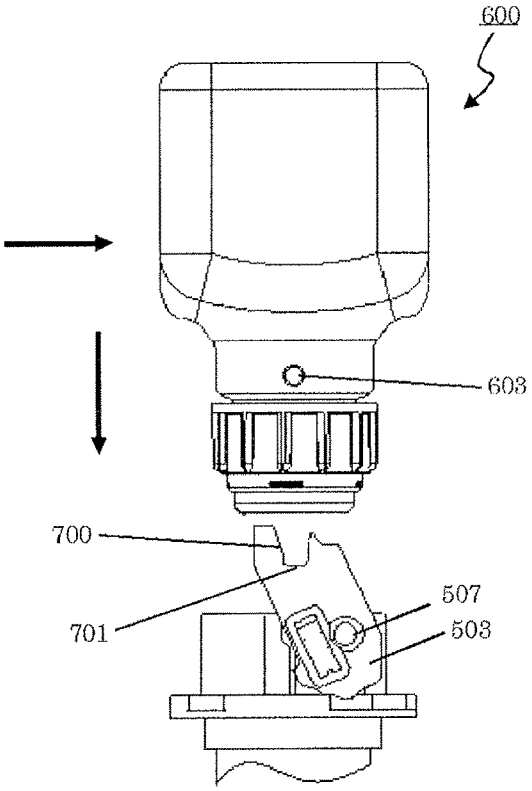
FIG. 7A is a diagram showing a direction in which a replenishing liquid bottle 600 is connected to an auxiliary ink reservoir 19.
Figure 7B:
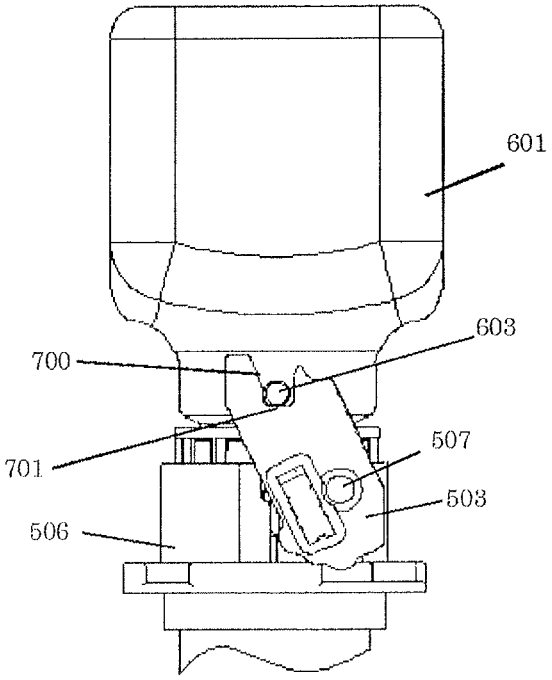
FIG. 7B is a diagram in which the replenishing liquid bottle 600 is set in the auxiliary ink reservoir 19.

FIG. 7A and FIG. 7B are state diagrams before connection to the main body side. FIG. 7A is a diagram showing a direction in which the replenishing liquid bottle 600 is connected to the auxiliary ink reservoir 19. FIG. 7B is a diagram in which the replenishing liquid bottle 600 is set in the auxiliary ink reservoir 19.

As shown in FIGS. 7A and 7B, the replenishing liquid bottle 600 is disposed on the upper surface of the adapter 506 with the cap top surface 605 facing downward. Thereafter, the replenishing liquid bottle 600 is brought close to the liquid replenishment opening 501. In this case, a recessed section is provided at a distal end portion of the lever cam 503. It is possible to guide the replenishing liquid bottle 600 to a connectable state by moving the boss 603 along a slope guide 700 that forms one sidewall surface of the recessed section.

The boss 603 can be temporarily placed on a flat section 701 corresponding to a bottom surface section of the recessed section of the lever cam 503 and positioned. The replenishing liquid bottle 600 is brought into a preparation state in which the replenishing liquid bottle 600 is prepared for being drawn into and connected to the auxiliary ink reservoir 19.

Figure 7C:
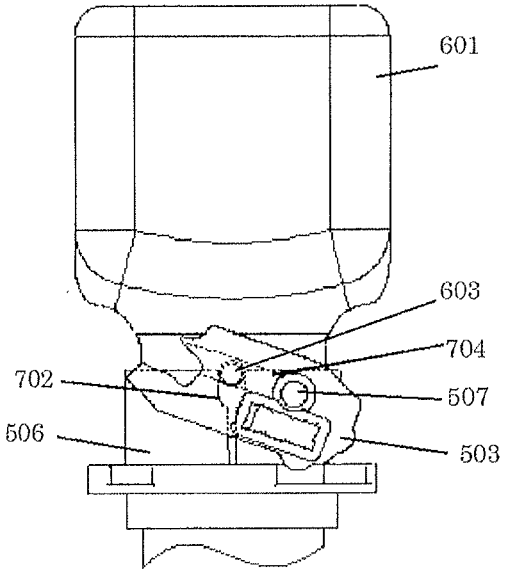
FIG. 7C is a diagram showing progress of connection of the replenishing liquid bottle 600 to the auxiliary ink reservoir 19.

FIG. 7C is a state diagram halfway in the connection to the main body side. When the replenishing liquid bottle 600 is drawn into the adapter 506, the operation lever 504 is pushed downward. Since the operation lever 504 is connected to the lever cam 503, when the operation lever 504 is pushed downward, it is possible to cause the lever cam 503 to perform a rotating action with a rotating shaft 507 being as an axis.

A guide groove 704 is provided on the inner side surface of the lever cam 503. The guide groove 704 communicates with the other sidewall surface on the opposite side of the slope guide 700 of the recessed section of the lever cam 503. When the operation lever 504 is pushed down, the lever cam 503 rotates. The boss 603 of the replenishing liquid bottle 600 is guided by the guide groove 704 from the flat section 701 of the recessed section of the lever cam 503 to move along the guide groove 704.

In this way, a portion of the guide groove 704 of the lever cam 503 opens vertically upward in a certain posture of a rotating action of the lever cam 503. Consequently, it is possible to easily take the boss 603 into the guide groove 704 of the lever cam 503 simply by placing the boss 603 of the replenishing liquid bottle 600 to match the portion opening vertically upward of the guide groove 704.

When the operation lever 504 is pushed down to a predetermined position, the boss 603 of the replenishing liquid bottle 600 is inserted into a U-shaped groove 702 provided in a portion of a wall surface on which the liquid replenishment opening 501 is formed. Connection of the replenishing liquid bottle 600 and the auxiliary ink reservoir 19 is completed.

In this way, according to the rotating action of the lever cam 503, it is possible to catch the boss 603 with the lever cam 503 and guide the replenishing liquid bottle 600 in the vertical direction into the adapter 506 along the U-shaped groove 702 formed in the liquid replenishment opening 501 of the auxiliary ink reservoir 19. It is possible to suppress, with the U-shaped groove 702, a shift in the rotating direction of the replenishing liquid bottle 600 during draw-in of the replenishing liquid bottle 600 and draw in the replenishing liquid bottle 600.

The guide in the vertical direction is performed by engagement of the boss 603 of the replenishing liquid bottle 600 and the U-shaped groove 702 provided on the wall surface on which the liquid replenishment opening 501 of the adapter 506 is formed. However, the guide in the vertical direction may be performed by engagement of the outer side surface of the bottle cap 602 of the replenishing liquid bottle 600 and the wall inner side surface of the adapter 506.

Figure 7D:
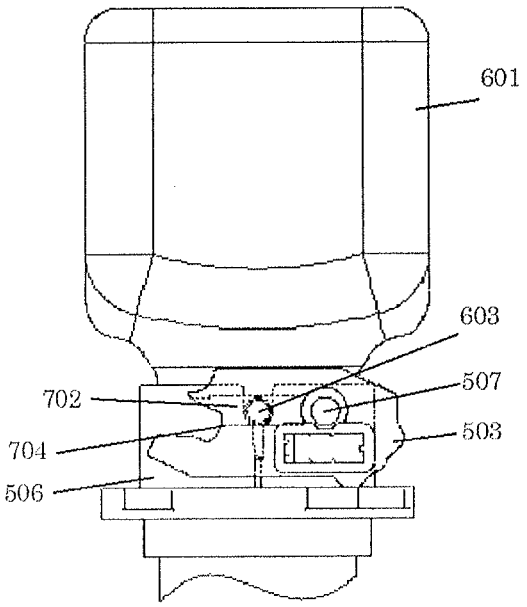
FIG. 7D is a diagram showing a detailed structure of a connection state of the replenishing liquid bottle 600 and the auxiliary ink reservoir 19.
Figure 7E:
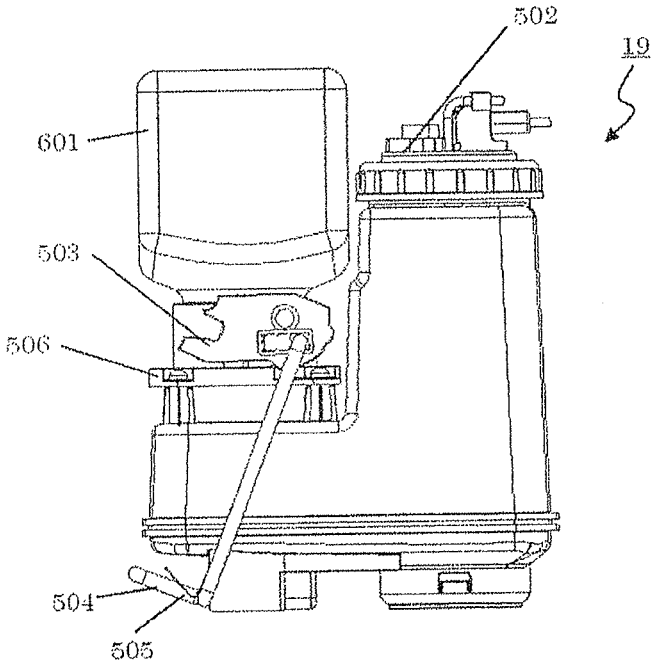
FIG. 7E is an overall view in the connection state of the replenishing liquid bottle 600 and the auxiliary ink reservoir 19.

FIGS. 7D and 7E are state diagrams during connection to the main body side. FIG. 7D is a detailed structure of a connection state of the replenishing liquid bottle 600 and the auxiliary reservoir 19. FIG. 7E is an overall view in the connection state of the replenishing liquid bottle 600 and the auxiliary reservoir 19.

In this state, the boss 603 stops at the lower end of the U-shaped groove 702 as shown in FIG. 7D. The operation lever 504 is positioned by the lever positioning plate 505 as shown in FIG. 7E.

During replacement of the replenishing liquid bottle 600 after a replenishment end, when the operation lever 504 is lifted upward, an operation opposite to the operation for drawing in the replenishing liquid bottle 600 is performed. Thus, it is possible to replace the replenishing liquid bottle 600.

Note that the user may be able to manually perform the operation of the operation lever 504 explained above. Alternatively, the operation lever 504 may be controlled to automatically operate.

Figure 8:
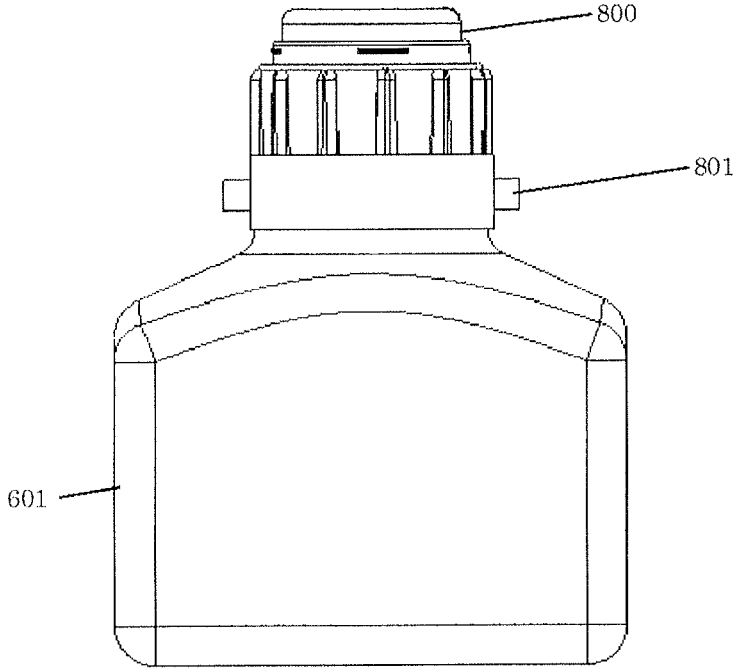
FIG. 8 is a diagram for explaining the structure of the replenishing liquid bottle 600 in the first embodiment.

Next, another configuration of the replenishing liquid bottle 600 is explained with reference to FIG. 8. Connection to the auxiliary ink reservoir 19 is the same as the connection explained above. Therefore, explanation of the connection is omitted. In the above explanation, when the replenishing liquid bottle 600 is drawn into the liquid storage reservoir 500, the boss 603 integrally provided in the replenishing liquid bottle 600 is drawn in by the lever cam 503. However, the boss 603 may be provided in the bottle cap 800.

Consequently, with the configuration according to the first embodiment, it is possible to provide a cartridge-type inkjet recording device capable of accurately and easily connecting a cartridge-type replenishing liquid bottle and an inkjet recording device.

Second Embodiment

This embodiment is a configuration example for further accurately and easily carrying out alignment of the replenishing liquid bottle 600 with respect to the auxiliary ink reservoir 19 in addition to the configuration of the first embodiment.

Figure 9:
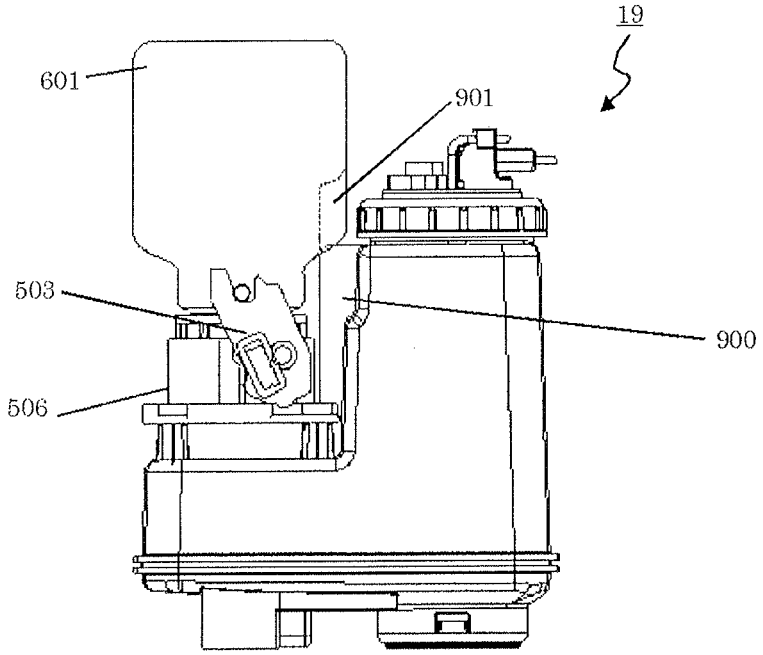
FIG. 9 is a diagram for explaining a connection structure of the replenishing liquid bottle 600 and the auxiliary ink reservoir 19 in a second embodiment.

FIG. 9 is a diagram for explaining connection of the replenishing liquid bottle 600 and the auxiliary ink reservoir 19 in a second embodiment. A rib 900 is provided in the auxiliary ink reservoir 19 and a recessed section 901 is provided on a side surface of the replenishing liquid bottle 600.

As in the first embodiment, the replenishing liquid bottle 600 is set on the upper surface of the liquid replenishment opening 501 in a state in which the bottle cap 602 faces downward. At this point, since the rib 900 interferes with the recessed section 901, it is possible to set the replenishing liquid bottle 600 in a position of a state in which the replenishing liquid bottle 600 can be drawn into the auxiliary ink reservoir 19.

It is also possible to prevent erroneous loading of ink and a solvent by changing the length of the rib 900 and the depth of the recessed section 901 for a liquid storage bottle for ink and for a liquid storage bottle for a solvent.

Consequently, with the configuration according to the second embodiment, it is possible to provide a cartridge-type inkjet recording device capable of accurately and easily connecting a cartridge-type replenishing liquid bottle and an inkjet recording device.

Third Embodiment

This embodiment is a configuration example incorporating a lock function of the operation lever 504 at the time when the replenishing liquid bottle 600 is set in the auxiliary ink reservoir 19 in addition to the configuration of the first embodiment.

Figure 10A:
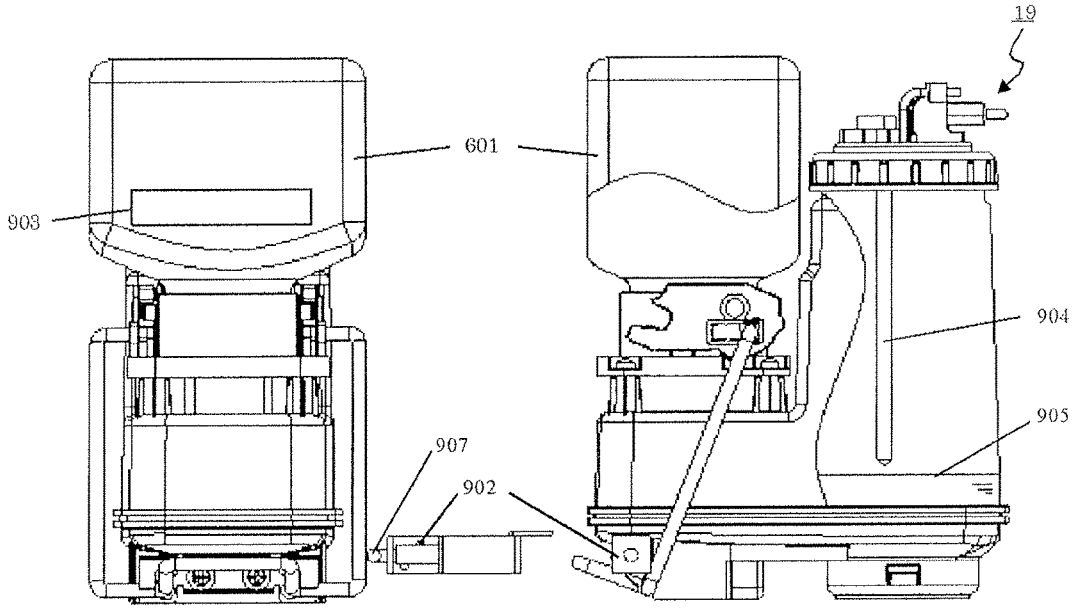
FIG. 10A is a diagram of an unlocked state of a lock mechanism of an operation lever 504 in a third embodiment.
Figure 10B:
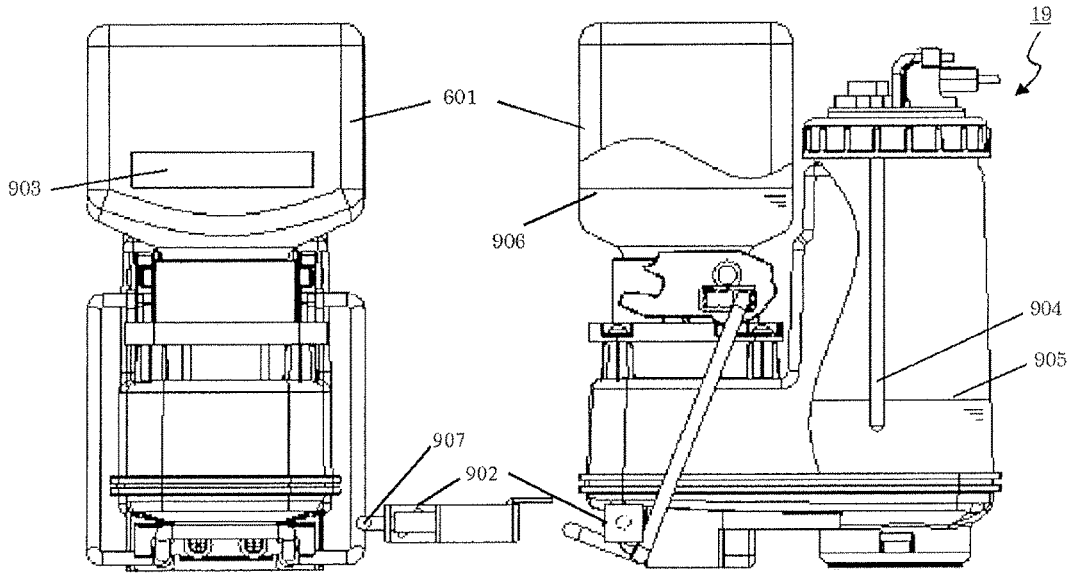
FIG. 10B is a diagram of a locked state of the lock mechanism of the operation lever 504 in the third embodiment.
Figure 10C:
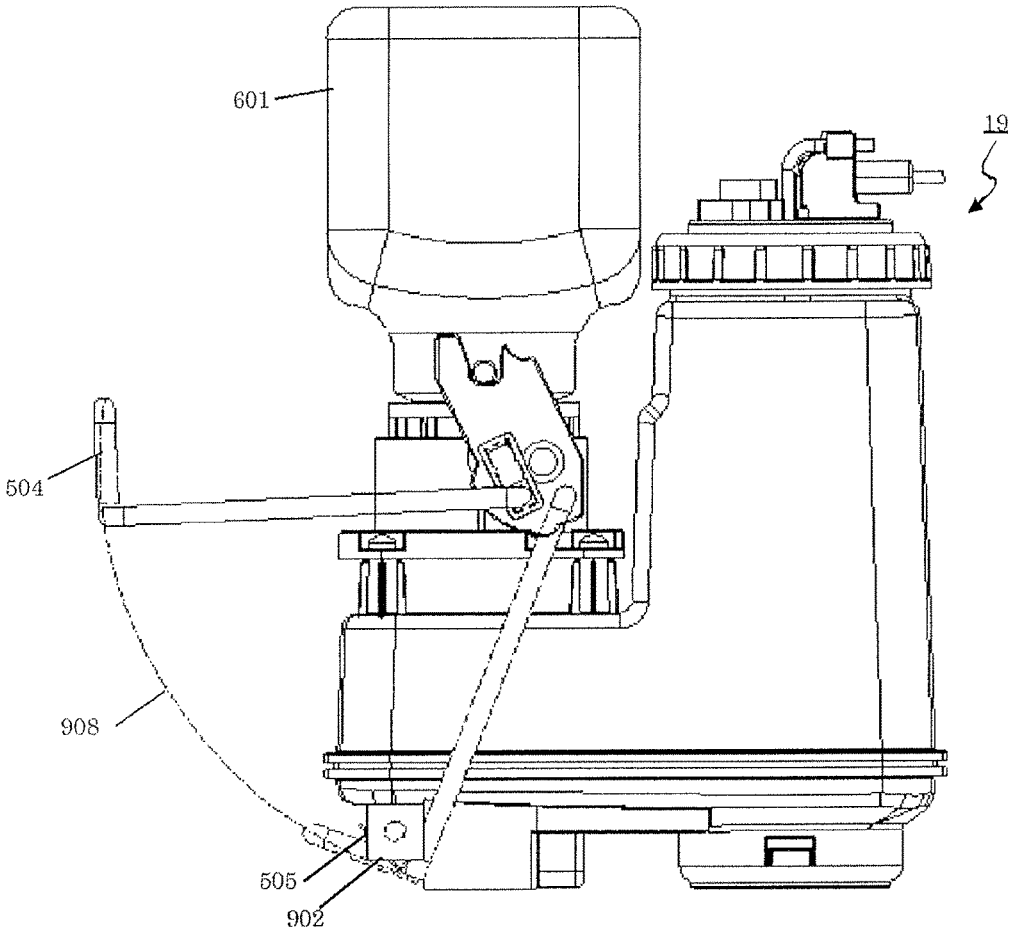
FIG. 10C is a diagram for explaining a locking operation of the lock mechanism of the operation lever 504 in the third embodiment.
Figure 10C:
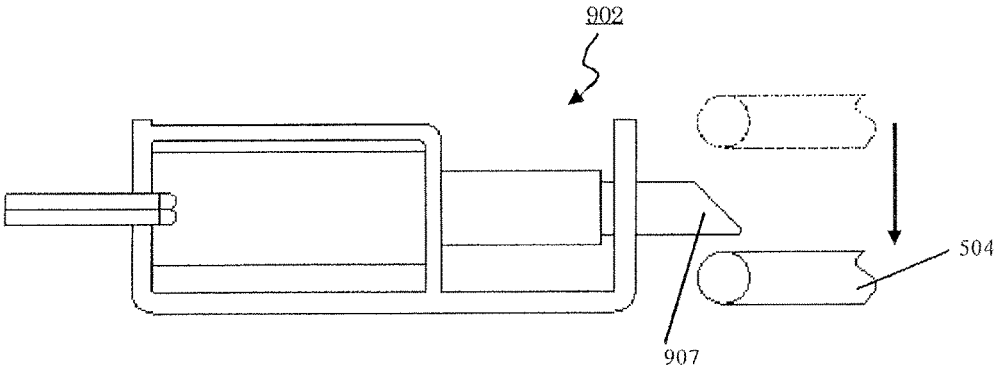
Figure 10D:
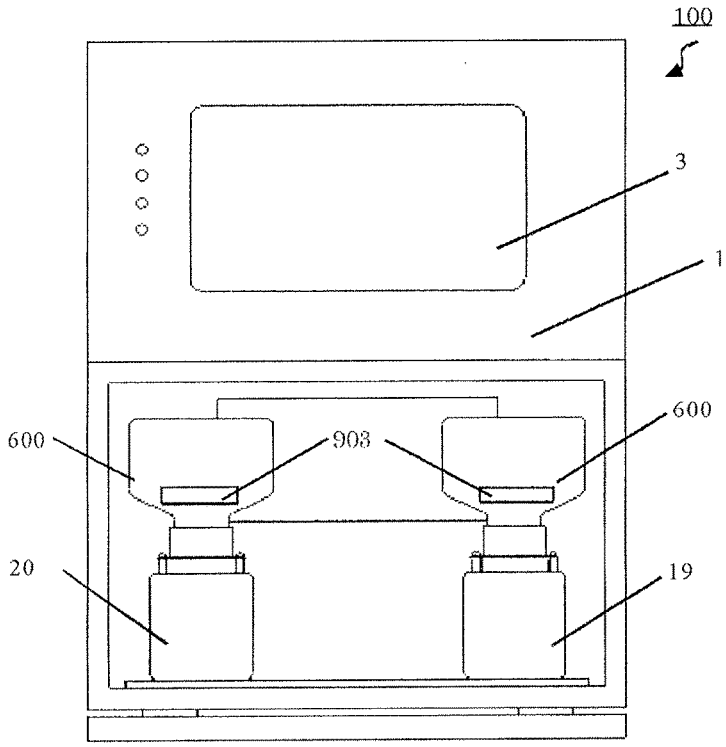
FIG. 10D is a diagram for explaining an unlock code input in unlocking of the lock mechanism of the operation lever 504 in the third embodiment.
Figure 10D:
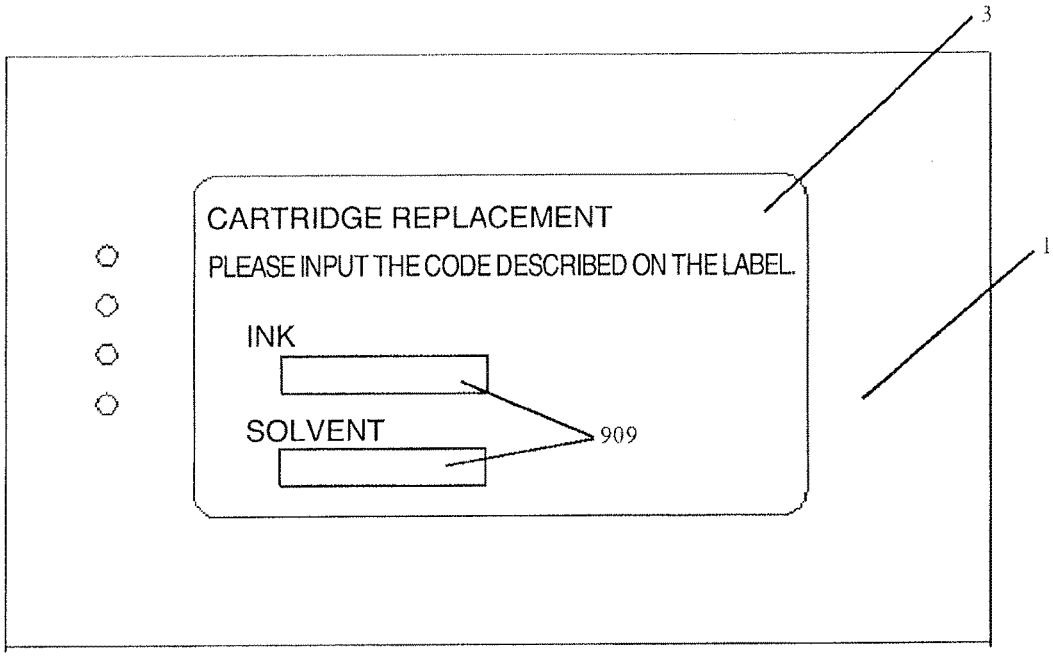

FIG. 10A is a diagram of an unlocked state by the lock mechanism of the operation lever 504. FIG. 10B is a diagram of a locked state by the lock mechanism of the operation lever 504. FIG. 10C is a diagram for explaining a locking operation of the lock mechanism of the operation lever 504. FIG. 10D is a diagram for explaining an unlock code input in the unlocking of the lock mechanism of the operation lever 504.

As explained in the first embodiment, in a state in which the replenishing liquid bottle 600 is connected to the auxiliary ink reservoir 19, the position of the operation lever 504 is fixed by the lever positioning plate 505. However, when unintended force from the outside is applied to the lever 504, it is likely that the operation lever 504 comes off the lever positioning plate 505 and the replenishing liquid bottle 600 comes off the adapter 506.

If the operation lever 504 comes off when the ink is stored in the replenishing liquid bottle 600, it is likely that the ink leaks and soils the periphery of the main body. Therefore, it is necessary to make it impossible to easily remove the replenishing liquid bottle 600.

Therefore, as shown in FIG. 10A, a solenoid lock 902 is provided near the lower end portion of the operation lever 504 as the lock mechanism to prevent the operation lever 504 from moving from a predetermined position, for example, a position where the operation lever 504 is fixed by the lever positioning plate 505.

A setting position of the solenoid lock 902 only has to be a position on the operation lever 504 at the time when the operation lever 504 is positioned by the lever positioning plate 505, that is, only has to be a position where the operation lever 504 can be locked not to be drawn up.

In this embodiment, the solenoid lock 902 is used as the lock mechanism. However, the lock mechanism is not limited to this. The lock mechanism in this embodiment prevents the operation lever 504 from moving from the predetermined position. The locked state means a state in which the operation lever 504 is unmovable from the predetermined position. The unlocked state means a state in which the operation lever 504 is movable from the predetermined position.

Details of the operation of the solenoid lock are explained with reference to FIGS. 10A, 10B, and 10C. The solenoid lock 902 includes a lock pin 907. The lock pin 907 is in a projected state to the operation lever 504 side (the front side) when the solenoid is not energized, and is in a retracted state to the opposite side (the rear side) of the operation lever 504 side when the solenoid is energized.

Therefore, when the solenoid is not energized, the operation lever 504 can be brought into the locked state and, when the solenoid is energized, the operation lever 504 can be brought into the unlocked state.

At this point, a detection result of a liquid-level detection sensor 904 is used for the control of the energization to the solenoid. In the case of a state in which a contact with the liquid is detected by the liquid-level detection sensor 904, the control section controls not to energize the solenoid. Consequently, when the liquid level is detected, the lock pin 907 is in the projected state to the front. The operation lever 504 can be brought into a lockable state.

On the other hand, in the case of a state in which the contact with the liquid is not detected by the liquid-level detection sensor 904, this is considered to indicate a replacement time of the replenishing liquid bottle 600. Therefore, the control section determines on the basis of detection information of the liquid-level detection sensor 904 that the energization to the solenoid is possible. However, in the unlocking in this embodiment, not only the detection result of the liquid-level detection sensor but also an input of an unlock code explained below is a condition for the unlocking.

When the solenoid is energized, the lock pin 907 changes to the retracted state to the back. The operation lever 504 can be brought into the unlocked state.

An unlocking method for the solenoid lock 902 is explained with reference to FIG. 10D. An image of a screen of a display section on the main body side is shown in FIG. 10D. When the unlocking is performed, a code for unlocking is input on an input screen on the main body side. As explained above, the unlocking is controlled to be performed when the unlock code is correctly input in a state in which a liquid level is not detected by the liquid-level detection sensor 904. A code described in a label with code 903, which is stuck to, for example, the side surface of the liquid storage bottle 600, may be set to be used as the unlock code.

The unlocking of the operation lever 504 is necessary, for example, mainly when the main body 1 is installed, when a cartridge of the ink or the solvent is replaced, when a use period of the ink or the solvent expires, when the ink is deteriorated, and when an ink type is changed.

As shown in the unlock code input screen shown in FIG. 10D, unlock code input boxes 909 for the ink and for the solvent are provided on the input screen. For example, when the user desires to replace the ink cartridge, the user inputs a code described in a label of an ink cartridge that the user desires to attach next. At this point, when a code on the ink side is input to the input box on the solvent side, the unlocking cannot be performed. Thus, it is possible to prevent erroneous loading due to a misunderstanding of the ink cartridge and the solvent cartridge.

In this embodiment, the code for the unlocking as described above is set. However, it is possible to appropriately set what kind of a code is used as the code for the unlocking. An input method for the lock code is not limited to the method explained above. The lock code may be input using communication means when the code input on the main body side is performed.

In this embodiment, the locked state of the operation lever 504 is released based on the detection result in the liquid-level detection sensor 904 in the auxiliary ink reservoir 19 and the input of the unlock code. Therefore, it is possible to prevent a risk that the operation lever 504 is unlocked in the state in which the ink is stored in the replenishing liquid bottle 600 shown in FIG. 10(*b*) and the ink leaks when the replenishing liquid bottle 600 is removed.

However, if the operation lever 504 has to be unlocked at timing when the unlocking is impossible, it is possible to open, in the main body 1, a dedicated screen for making it possible to operate the lock pin 907 with a password issued to a maintenance person and unlock the operation lever 504 with button operation.

On the other hand, in the configuration explained above, when the solenoid lock operates and the operation lever 504 is unlocked, the solenoid has to be continuously energized until the operation lever 504 is brought into the locked state next time. In this configuration, there is a problem in that power consumption increases.

Therefore, when the operation lever 504 is still in the unlocked state even if a predetermined time elapses, the lock pin 907 may be controlled to return to the locked state.

In this case, a problem occurs in that the cartridge cannot be replaced because the predetermined time elapses and the operation lever 504 changes to the locked state before the cartridge is replaced with the next cartridge. The operation of the operation lever 504 and a locking operation of the operation lever 504 by the solenoid lock 902 are explained with reference to FIG. 10C taking this problem into account.

A setting position of the solenoid lock 902 is in a position where the position of the distal end of the lock pin 907 in the projected state without the energization to the solenoid comes into contact with the operation lever 504 when the operation lever 504 is lowered.

The lock pin 907 is in the forward projected state in a state in which the solenoid is not energized. However, the lock pin 907 can be retraced backward. The lock pin 907 is configured to be pushed out forward by an elastic body such as a spring. Therefore, it is possible to move the position of the distal end of the lock pin 907 by pushing in the lock pin 907 backward.

When the replenishing liquid bottle 600 is connected, the operation lever 504 is pushed down in the arrow direction and comes into contact with the lock pin 907. At this point, since a side of the distal end of the lock pin 907 in contact with the operation lever 504 is taper-shaped, the lock pin 907 moves in the backward retracting direction when the operation lever 504 is inserted. Therefore, it is possible to smoothly insert the operation lever 504 to the depth.

On the other hand, even if it is attempted to draw up the operation lever 504 and return the operation lever 504 to a state before the insertion, the distal end of the lock pin 907 does not move from the projected state. Therefore, it is possible to bring the operation lever 504 into an immovable state.

With this configuration, even when the unlocked state is ended after the predetermined time has elapsed and the operation lever is brought into the locked state, it is possible to push down the operation lever and connect the cartridge. Further, it is possible to bring the operation lever into the locked state after the cartridge connection.

Note that, in this embodiment, in the unlocking of the operation lever, the detection result in the liquid-level detection sensor 904 in the auxiliary ink reservoir 19 and the input of the unlock code are explained as the conditions. However, the operation lever may be able to be unlocked according to only one of the conditions.

Consequently, with the configuration according to the third embodiment, it is possible to provide a cartridge-type inkjet recording device capable of accurately and easily connecting a cartridge-type replenishing liquid bottle and an inkjet recording device. Further, it is possible to prevent the connected cartridge-type replenishing liquid bottle from being erroneously removed.

Fourth Embodiment

Figure 11:
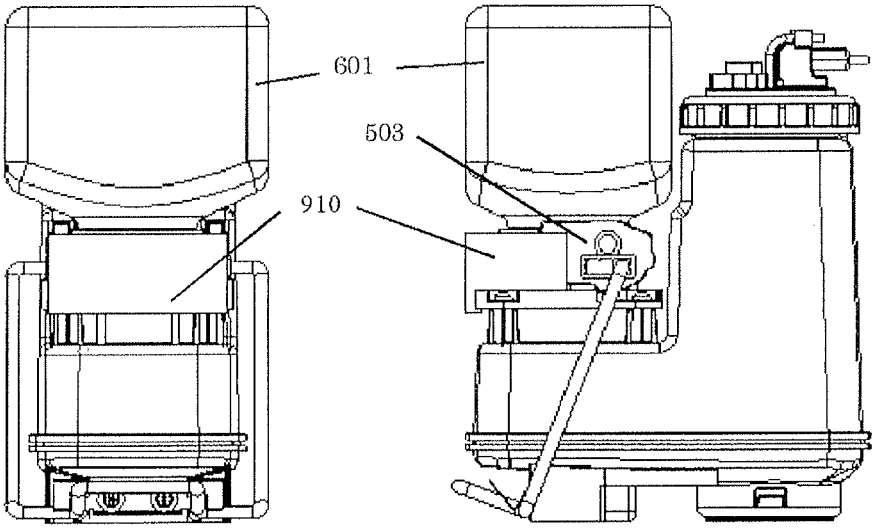
FIG. 11 is a diagram for explaining another idea of a lock mechanism in a fourth embodiment.

This embodiment is another idea of the lock mechanism of the operation lever explained in the third embodiment. FIG. 11 is a diagram for explaining the lock mechanism in this embodiment.

In the embodiment, by attaching a lock piece 910 when lever operation ends, the lever cam 503 interlocking with the operation lever 504 is configured such that the replenishing liquid bottle 600 does not easily come off.

The replenishing liquid bottle 600 interlocking with the operation lever 504 may be configured to be pressed down.

Consequently, with the configuration according to the fourth embodiment, it is possible to provide a cartridge-type inkjet recording device capable of accurately and easily connecting a cartridge-type replenishing liquid bottle and an inkjet recording device.

REFERENCE SIGNS LIST

100 inkjet recording device
1 main body
2 printing head
3 operation display section
4 conduit
8 nozzle
10 ink particle
11 charging electrode
12 deflection electrode
13 printing target object
14 gutter
18 main ink tank
19 auxiliary ink reservoir
20 makeup reservoir
21 viscometer
22, 23, 24 electromagnetic valve
25 pump for ink supply
26 pump for ink collection
27 pump for solvent collection
28, 29 filter
30 pressure reducing valve
31 pressure sensor
32 exhaust opening
501 liquid replenishment opening
502 atmospheric air opening
503 lever cam
504 operation lever
505 lever positioning plate
506 adapter
507 rotating shaft
600 replenishing liquid bottle
601 liquid storing section
602 bottle cap
603 boss
604 protrusion
605 cap top surface
606 over-cap
607 protrusion
700 slope guide
701 flat section
702 U-shaped groove
703 rotating shaft
704 guide groove
800 bottle cap
801 bottle boss
900 rib
901 recessed section
902 solenoid lock
903 label with code
904 liquid-level detection sensor
905 liquid level in the auxiliary ink reservoir
906 liquid level in the replenishing liquid bottle
907 lock pin
908 lever track
909 code input box
910 lock piece

The invention claimed is:

1. A cartridge-type inkjet recording device comprising:

a liquid reservoir to which a replenishing liquid bottle is removably attachable, wherein the liquid reservoir includes: a liquid replenishment opening for replenishing liquid from the cartridge-type replenishing liquid bottle;

a cam provided on a periphery of the liquid replenishment opening, the cam engaging with a portion of the cartridge-type replenishing liquid bottle, and the cam moving the cartridge-type replenishing liquid bottle in a vertical direction; and a cam operation section for operating the cam, wherein the cam includes: a recessed section at a distal end portion for engaging with a portion of the cartridge-type replenishing liquid bottle, and a groove for communicating with the recessed section and guiding the part of the cartridge-type replenishing liquid bottle to a predetermined position.

2. The cartridge-type inkjet recording device according to claim 1, wherein the liquid reservoir includes a rotating shaft connected to the cam, and the cam is rotated by the rotating shaft to move the cartridge-type replenishing liquid bottle in the vertical direction.

3. The cartridge-type inkjet recording device according to claim 2, wherein the cam operation section is a lever.

4. The cartridge-type inkjet recording device according to claim 3, further comprising a lever positioning section for positioning the lever in a predetermined position.

5. The cartridge-type inkjet recording device according to claim 4, further comprising a lever lock section for locking the lever not to move.

6. The cartridge-type inkjet recording device according to claim 5, further comprising: a display section for displaying an operation screen for releasing a lever locked state in the lever lock section; and an input section for inputting unlock information of a lever lock on an operation screen of the display section.

7. The cartridge-type inkjet recording device according to claim 6, further comprising: a liquid-level detection sensor provided in the liquid reservoir; and a control section, wherein when a liquid level is detected by the liquid-level detection sensor, the control section controls the lever lock section to bring the lever into a locked state, when the liquid level is not detected by the liquid-level detection sensor, the control section controls the lever lock section to bring the lever into an unlockable state, and in the unlockable state, when unlock information set by the input section is input, the control section controls the lever lock section to bring the lever into an unlocked state.

8. The cartridge-type inkjet recording device according to claim 5, further comprising: a liquid-level detection sensor provided in the liquid reservoir; and a control section, wherein when a liquid level is detected by the liquid-level detection sensor, the control section controls the lever lock section to bring the lever into a locked state, and when the liquid level is not detected by the liquid-level detection sensor, the control section controls the lever lock section to bring the lever into an unlocked state.

9. The cartridge-type inkjet recording device according to claim 8, wherein the lever lock section is a solenoid lock.

10. The cartridge-type inkjet recording device according to claim 8, wherein the lever lock section is a lock piece for fixing a cam connected to the lever not to move.

11. The cartridge-type inkjet recording device according to claim 10, further comprising, in the liquid reservoir, a guiding section for guiding connection of the replenishing liquid bottle.

* * * * *